US006095706A

United States Patent [19]

Hashimoto et al.

[11] Patent Number: 6,095,706

[45] Date of Patent: Aug. 1, 2000

[54] WRITING INSTRUMENT OPERATED BY A FINGER AT A HOLDING POSITION

[75] Inventors: Yasuyuki Hashimoto, Nishinomiya; Haruo Yamashita, Akashi, both of Japan

[73] Assignee: Ancos Co., Ltd., Osaka, Japan

[21] Appl. No.: 07/648,527

[22] Filed: Jan. 30, 1991

[30] Foreign Application Priority Data

Jan. 30, 1990 [JP] Japan ..... 2-17884
Apr. 10, 1990 [JP] Japan ..... 2-93202

[51] Int. Cl.[7] ..... B43K 24/02

[52] U.S. Cl. ..... 401/111; 401/110; 401/99

[58] Field of Search ..... 401/99, 111, 110, 401/117, 109, 62, 65, 82, 106

[56] References Cited

U.S. PATENT DOCUMENTS

| | | | |
|---|---|---|---|
| 3,079,894 | 3/1963 | Johmann | 401/31 |
| 3,558,233 | 1/1971 | Zepell | 401/106 |
| 3,724,960 | 4/1973 | Hashimoto, et al. . | |
| 4,381,158 | 4/1983 | Gerganese | 401/111 |

FOREIGN PATENT DOCUMENTS

| | | | |
|---|---|---|---|
| 2198993 | 6/1988 | Br. Indian Ocean Ter. | 401/99 |
| 1274890 | 9/1961 | France . | |
| 1482711 | 5/1967 | France | 401/99 |
| 1461616 | 4/1969 | Germany . | |
| 1511387 | 7/1974 | Germany . | |
| 3705097 | 9/1987 | Germany | 401/99 |
| 4038922 | 6/1991 | Germany . | |
| 507393 | 12/1954 | Italy | 401/99 |
| 615636 | 6/1961 | Italy | 401/99 |
| 39-6410 | 3/1939 | Japan . | |
| 34-7181 | 8/1955 | Japan . | |
| 46-18815 | 7/1971 | Japan . | |
| 50-25846 | 8/1975 | Japan . | |
| 52-2328 | 1/1977 | Japan . | |
| 53-127030 | 11/1978 | Japan . | |
| 54-24324 | 8/1979 | Japan . | |
| 55-14552 | 4/1980 | Japan . | |
| 130503 | 1/1951 | Sweden | 401/104 |

*Primary Examiner*—David J. Walczak
*Attorney, Agent, or Firm*—Jordan and Hamburg LLP

[57] ABSTRACT

A writing instrument operated by a finger at a holding position comprising a hollow body for containing at least one refill, in which each refill is always forced toward a retracted position in the hollow body, and is moved between the writing position and a resting position by means of a cam mechanism which is operated by an actuating knob provided at a position near the portion of the hollow body to be grasped by a user's finger-tips.

8 Claims, 7 Drawing Sheets

WRITING INSTRUMENT OPERATED BY A FINGER AT A HOLDING POSITION

BACKGROUND OF THE INVENTION

The present invention relates to a writing instrument operated by a finger at a holding position.

Conventionally, there have been proposed various writing instruments each of which has a permanently exposed tip and a cap for protecting the exposed tip and preventing any contamination by the tip. Such writing instruments are commonly and mainly used as ball-point pens using an oil-based ink or a water-based ink and are kept mainly on a desk. In conventional ball point pens of this type, however, the cap should be taken off and put on when the pen is to be used and thus the handling thereof is troublesome.

With ball point pens using a water-based ink there have been reported accidents in which a cap which had been removed by mouth, became wedged in a child's throat causing suffocation.

There have been also for a long time proposed and used capless writing instruments or ball-point pens using an oil-based ink or a water-based ink. In such capless writing instruments a knocking type propelling mechanism is provided on the rear end of a body, or a rotating type propelling mechanism is used in which the propelling of the tip of the refill may be performed by mutually rotating the front portion and rear portion of the body. With these previously proposed capless writing instruments, when in use, it is necessary that the user change his or her grip on the body and then push the knocking mechanism or mutually rotate the front and rear portions of the body. Therefore, capless writing instruments of this kind have a disadvantage that handling is very troublesome. With capless writing instruments using water-based ink in which an ink reservoir and an air passage bore are so arranged and positioned that loss of the ink is minimized, there is provided a mechanism for retracting the tip and thus the refill, which may often be operated by a clip when being inserted into the user's pocket. This mechanism comprises a spring for forcing the refill to a retracted position. This spring has a strong spring tension and thus a core member in the refill may be displaced backwardly due to the shock which will occur at the retraction of the refill. This will also lead to cessation of writing.

Further, since the conventional capless writing instruments have no means for displaying retracting and propelling positions, the tip may be left unretracted. Moreover, when a writing instrument of the clip operating type is inserted into the user's pocket without operating the clip, the clothes of the user may be soiled by the exposed tip.

Furthermore, writing instruments of a double tip type are known which have an exposed and fixed tip on each side. One known pen of this type has different colored refills at the respective ends. Another has a pen having different type refills (for example, a water-based ink refill and a refill made of a suitable soft material into which an ink is infiltrated). Still another pen has ball-points or cores which have different diameters. With a ball-point pen of a water-based ink refill type it is necessary to provide caps for preventing any loss and leakage of the ink from the respective ball-points. With the ball-point pen of an oil-based ink refill type it is also necessary to provide caps for preventing contamination with ink from the respective tips.

Japanese Utility Model Publication No. 55-14552 and Japanese Patent Prepublication No. 53-127030 disclose a further knocking type writing instrument provided with writing tips at the both ends. In this conventional knocking type instrument, the user removes a pen-cap from one of the tips which is intended to be used for writing, fits it on a pen cap for the other tip, and pushes the fitted pen-caps so as to project the intended tip. In this case it is required that the user removes and replaces the pen-caps with both hands, which is troublesome.

SUMMARY OF THE INVENTION

It is therefore an object of the present invention to provide a writing instrument capable of overcoming the problems or disadvantages of conventional writing instruments, actuating the operating member by a finger near a holding position of an instrument body, requiring no pen-cap for preventing any loss of ink and any contamination due to a leakage of the ink, and being simply assembled at a lower cost.

Another object of the present invention is to provide a writing instrument of the double tip type capable of overcoming the problems or disadvantages of the conventional writing instruments provided with tips at both ends, actuating the operating member by a finger provided near a holding position of an instrument body at both ends, requiring no pen-cap for preventing any loss of an ink and any contamination due to a leakage of the ink, and being simply assembled at a lower cost.

According to the present invention, there is provided a writing instrument comprising a hollow body, a writing member accommodated in said hollow body, said hollow body having a forward end portion provided with an opening through which a tip of said writing member is extendable, a spring accommodated in said hollow body for forcing said writing member backwardly to retain it at a retracted position in which said tip is retracted in said hollow body, means for moving said writing member between said retracted position and a writing position in which said tip protrudes out of said opening, said moving means including a rotary cam which has a central bore through which said writing member is extendable, a sliding cam having a cam surface to engage with said rotary cam and a bore through which said writing member is extendable and intended for actuating said rotary cam when being displaced forwardly toward said forward end portion, and cam grooves with which said rotary cam and said sliding cam are engaged, respectively, an operating member provided on said hollow body and arranged to be operated by any one of a user's fingers at a holding position for operating said moving means to protrude and retract said writing member, said holding position being the position at which the writing instrument, in use, is held by a user's finger tips, and means extended through a slit provided in said hollow body for connecting said sliding cam and said operating member, said writing member being advanced and locked at the writing position by moving said operating member forwardly to engage said rotary cam with said cam grooves, and being retracted into said hollow body by moving said operating member forwardly again to disengage said rotary cam from said cam grooves.

Also, said moving means may comprise a conventional cam mechanism, for example, a rotary cam, a sliding cam and cam grooves as disclosed in Japanese Patent Publication Nos. 34-7181 and 50-25846.

Alternatively, said moving means may be formed by an eccentric heart shaped groove as disclosed in Japanese Utility Model Publication No. 39-6410 and Japanese Patent Publication No. 54-24324, or an assembly of cam grooves and an inclined member as disclosed in Japanese Utility Publication No. 46-18815 and Japanese Patent Publication No. 52-2328.

The writing instrument of the present invention may be constructed so that said hollow body has openings at both ends through which tips of two different type writing members pass respectively, thereby each set of said biasing means, said moving means, said operating members and said connecting means being provided at each side of said hollow body.

Preferably, two writing members may be changeable in said hollow body.

The present invention will now be described by way of example with reference to the accompanying drawings:

DETAILED DESCRIPTION

Referring to FIGS. 1 to 7, there is shown a retractable writing instrument according to an embodiment of the present invention, which is assembled as a ballpoint pen using an oil-based ink and is intended to be used on a desk.

Figure 1:
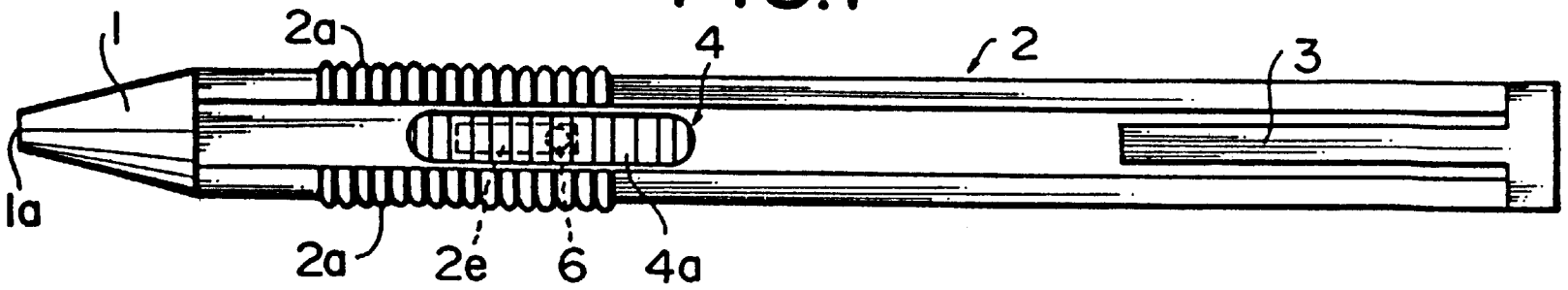
FIG. 1 is a plan view showing a writing instrument according to one embodiment of the present invention.
Figure 2:
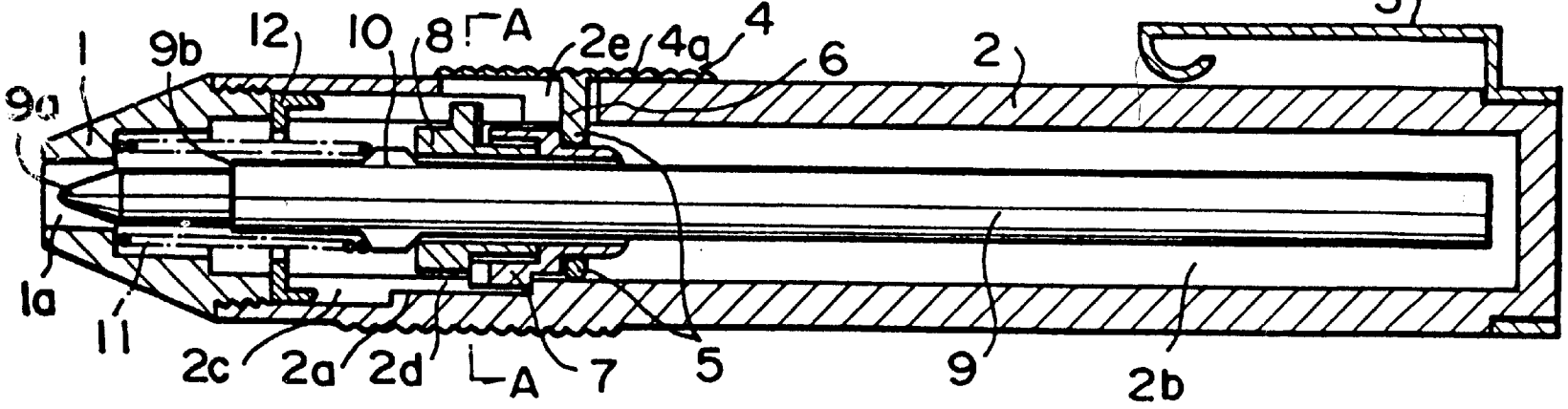
FIG. 2 is a laterally enlarged longitudinal section showing the writing instrument of FIG. 1, in which the tip of the refill is retracted into a hollow body.
Figure 3:
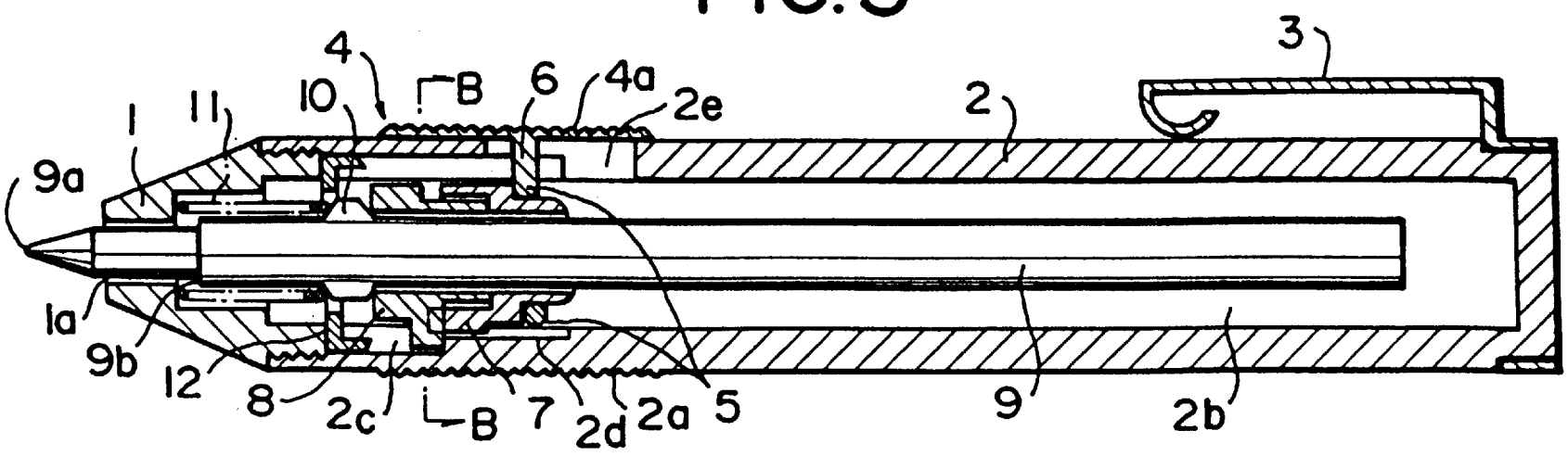
FIG. 3 is a laterally enlarged longitudinal section showing the writing instrument of FIG. 1 in a writing position.

The reference numeral 1 represents a ferrule having a tapered peripheral surface. The ferrule 1 has a forward end portion provided with an opening la and a rear end portion of relatively small diameter provided with an external thread as shown in FIGS. 2 and 3. The ferrule 1 may be made of metal, synthetic resin or other suitable material. The reference numeral 2 represents a sheath which has one end or front end portion opened and the other end or rear end portion closed. The opened front end portion of the sheath 2 is provided with an internal thread at the inner side. The closed rear end portion of the sheath 2 has a diameter smaller than that or the other portion thereof. On the closed rear end portion is removably mounted a clip 3. The external thread of the ferrule 1 is engaged with the internal thread on the inner side of the opened front end portion of the sheath 2 and thus the ferrule 1 and the sheath 2 is integrally assembled to form an instrument body.

Figure 4:
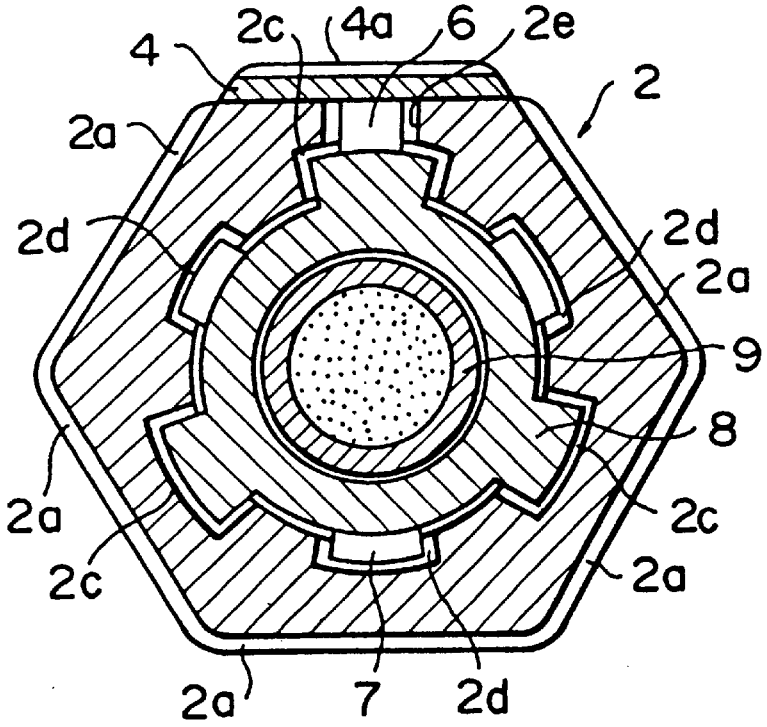
FIG. 4 is an enlarged cross section along the lines A—A in FIG. 2.
Figure 5:
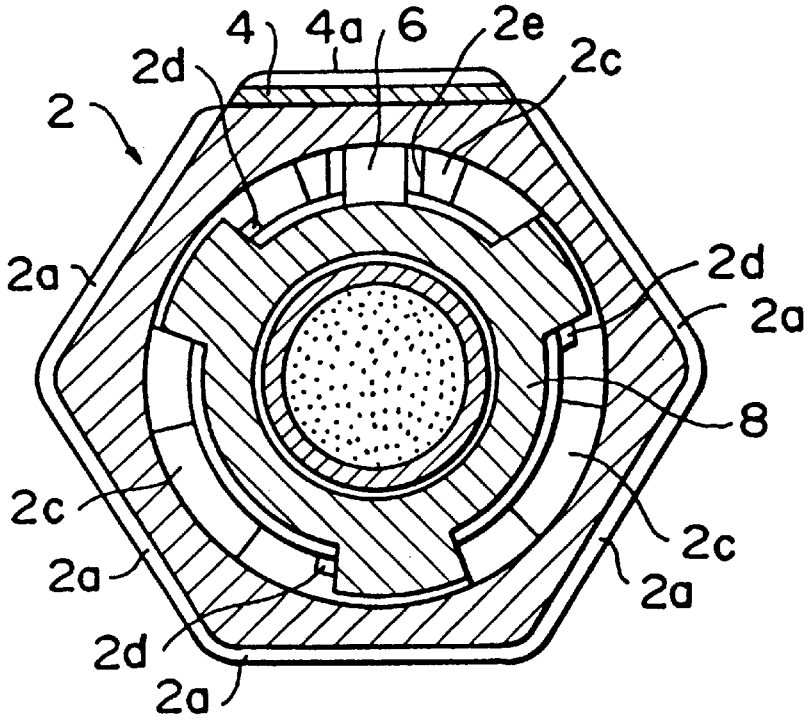
FIG. 5 is an enlarged cross section along the lines B—B in FIG. 3.

The sheath 2 has a hexagonal outer surface and a circular inner surface in cross section as shown in FIGS. 4 and 5. One of six surface portions of the hexagonal outer surface of the sheath 2 is smoothly formed and the remaining five surface portions are provided with a knurling 2*a* over the portion to be grasped by the user's fingertips when in use. Within the sheath 2 there is defined a cylindrical space 2*b* which extends from the closed rear end portion to the position near the front end portion.

Figure 6:
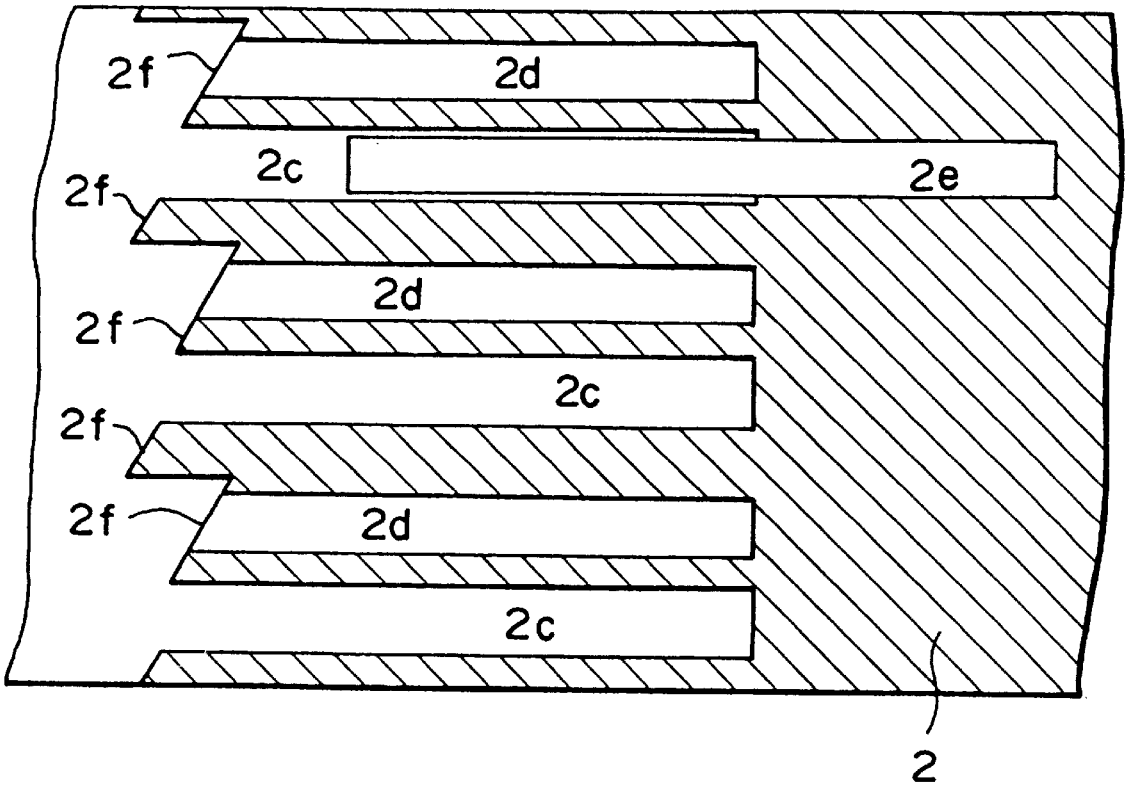
FIG. 6 is a view showing cam grooves and slits which form a propelling or driving mechanism in the writing instrument of FIGS. 1 to 5.

As shown in FIGS. 4, 5 and 6, the opened front end portion is provided with three deep cam grooves 2*c* and three shallow cam grooves 2*d* which are alternately arranged and are equally spaced along the inner peripheral surface.

Figure 7:
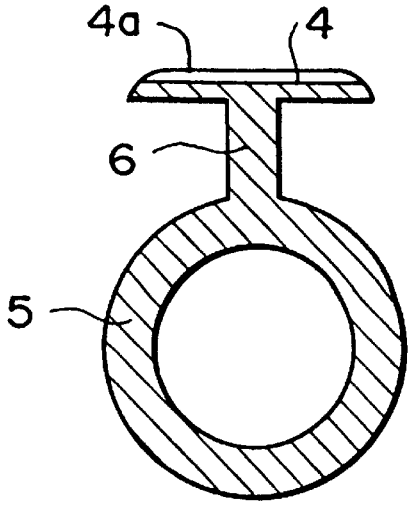
FIG. 7 is a view showing an another part in the writing instrument of FIGS. 1 to 5.

The reference numeral 4 denotes an operating member which as shown in FIG. 7, is coupled with an annular member 5 via a connecting rod 6. These components are integrally constructed by a suitable material. The annular member 5 and the connecting rod 6 have a circular cross section of the same diameter. The operating member 4 has a knurled surface 4*a* for preventing the user's fingertips from slipping. The inner diameter of the annular member 5 is set so that it can be tightly fitted on the outer portion of a sliding cam 7. In this connection the operating member 4 may be thinner and any suitable shape. Instead of the provision of the knurled surface 4*a*, therefore, it is possible to engrave the operating member 4 with a symbolic mark of the city or school, the emblem of a company or the main character of a favorite comic picture or the like for making propaganda as well as the protection against slipping.

Alternatively, the operating member 4 may be formed so that it has a shape similar to that of the emblem of the company or school.

The smoothly formed outer surface portion of the sheath 2 is provided with a slit 2*e* at the front portion with which the operating member slidably engaged.

It is appreciated that the slit 2*e* should be formed so that it does not intersect the inclined surface 2*f* of the associated cam groove. The slit 2*e* should also be arranged so that it has a width slightly larger than that of the operating member 4 and a length longer than that of the diameter of the connecting rod 6 plus a stroke of slide of required to drive the propelling mechanism.

It will be now described how the operating member shown in FIG. 7 is mounted in the sheath 2.

Firstly, the annular member 5 of the operating member is aligned with the slit 2*e* and then is inserted through it into the sheath 2. The connecting rod 6 is positioned within the slit 2*e*.

Next, the operating member 4 is aligned with the slit 2*e* by rotating the former by 90°, which results in that the annular member 5 is coaxially disposed within the sheath 2 as shown in FIGS. 2 and 3.

In the sheath 2, there are provided a sliding cam 7 and a rotary cam 8 which may be of any suitable conventional type. The sliding cam 7 is cylindrical and has a rear portion on which the annular member 5 of the operating member is tightly fitted so that the operating member 4 can be moved forwards and backwards along the slit 2*e* without substantial lateral shaking. The rear portion of the rotary cam 8 is inserted into the front portion of the sliding cam 7. The rotary cam 8 has a central bore of an inner diameter which is approximately equal to that of the central bore of the sliding cam 7. The inner diameter of the central bore in each of the cams 7 and 8 is determined to be slightly larger than the diameter of a writing member or a refill 9 so as to receive it.

The refill 9 is provided with a tip 9*a* at the front end and is inserted through the central bores of the cams 7 and 8 into the cylindrical space 2*b* in the condition shown in FIG. 2 in which the sliding cam 7 and the rotary cam 8 lie in a retracted or backward position. In the illustrated embodiment, the refill 9 is provided with an annular protuberance or crimp 10 which abuts on the front edge of the rotary cam 8. On the front portion of the refill 9 is engaged a spring member 11. By mounting the ferrule 1 on the front end portion of the sheath 2 the spring member 11 is slightly compressed between the annular protuberance 10 of the refill 9 and the inner shoulder portion of the ferrule 1. In this condition, the tip 9*a* of the refill 9 lies in the ferrule 1 or the retracted postion.

When the assembly lies in the condition of FIG. 2, the portion of the larger diameter of the sliding cam 7 abuts on the rear edge of the shallow cam grooves 2*d* and thus the refill 9 is retained in the retracted position by the moving mechanism. However, it should be understood that the refill 9 is not necessarily retained in the retracted position by the moving mechanism. In that case each shallow cam groove 2*d* may be provided with no rear engaging edge. The refill 9 may be retained in the retracted position by abutting the connecting rod 6 of the operating member on the rear edge of the slit 2*e* or by abutting the rear end of the refill 9 on the inner side of the closed rear end portion of the sheath 2.

As shown in FIGS. 2 and 3, adjacent to the rear end of the internal thread in the sheath 2 there is tightly provided a slightly elastic ring 12 of synthetic resin which is intended to prevent the sliding cam 7 and the rotary cam 8 from being out of place when the ferrule 1 is removed for replacing the used refill 9 and then the refill 9 is removed. The ring 12 has an inner diameter which is larger than the outer diameter of the annular protuberance 10 of the refill 9 but smaller than the outer diameter of the rotary cam 8.

In the illustrated writing instrument in use the user graspes the portion of the sheath 2 to be grasped by his or her fingertips during a writing condition, and pushes the operating member 4 toward the most advanced position with any one (for example the thumb) of his or her fingers. As a result, the sliding cam 7 is forwards moved against the spring 11 by the annular member 5 of the operating member and then is shifted up to the most advanced position thereby slightly rotating the rotary cam 8. After that, as the pushing of the operating member 4 is ceased the rotary cam 8 is slightly retracted by the function of the spring 11 while being rotated and thus is engaged with the front edge of each shallow cam groove 2*d*. In this way the assembly is taken in the condition of FIG. 3 in which the tip 9*a* of the refill 9 is protruded from the opening la and set at the writing position.

At the termination of the writing, by again forcing the operating member 4 forwards, the sliding cam 7, the rotary cam 8 and the refill 9 may be further advanced and then as the forcing of the operating member 4 is released these components are retuned to the initial or retracted position as shown in FIG. 2.

There will herein be omitted the detailed description about the functions or operations of the sliding cam 7, the rotary cam 8, the deep cam grooves 2*c* and the shallow cam grooves 2*d* because they are widely used in conventional knocking type ball-point pens.

In the above mentioned embodiment, when the operating member 4 is further forced fowards in the condition of FIG. 3, the rotary cam 8 may be advanced until the leading edge thereof brings into contact with the stopper ring 12. In that case the annular protuberance 10 on the refill 9 may be moved through the ring 12 because it is slightly elastic, and also the refill 9 may be moved untill the front shoulder 9*b* thereof abuts against the inner shoulder portion of the ferrule 1. Further, the assembly is so arranged that the rotary cam 8 is operated during this advancing stroke.

In the condition of FIG. 3, if the operating member 4 is forcedly advanced, the annular member 5 and the connecting rod 6 of the operating member, and the sliding cam 7 fitted on the annular member 5 are then moved backwards up to the position shown in FIG. 2, but the rotary cam 8 is retained at the advanced position as shown in FIG. 3. In this connection, it should be appreciated that no retracting force can be applied to the operating member 4.

In case the operating member 4 and the connecting rod 6 are constructed to have a strength which may sufficiently bear up against the writing pressure of the instrument, it is possible to use the instrument while holding the operating member 4 at the most pushed out position with the user's finger, that is under the condition that the tip 9*a* is pushed out forwards more than the position shown in FIG. 3. This is particularly convenient when the writing instrument is to be used with a ruler or the writing instrument is to be used while the tip 9*a* of the refill 9 is extremely extended.

In the present invention, the operating member can be smoothly and easily advanced forwardly since the strength of the biasing means 11, pressing against refill 9 can be such that it can just resist forward movement of the refill caused by shock from daily use.

The writing instrument mentioned above is only one example based on the present invention, and modifications are possible. For instance the present invention can be adapted to mechanical pencils and sign-pens.

In the embodiment illustrated in FIGS. 1 to 7, the arrangement may be modified so that the inner diameter of the annular member 5 is slightly larger than the outer diameter of the rear engaging portion of the sliding cam 7 and thus the former is loosely engaged on the latter. Alternatively, it is possible to use any suitable propelling mechanism which may be operated by the operating member via a connecting or coupling means. Also, the propelling mechanism may be designed so that the annular member is engaged with the rear end portion of the refill and the connecting rod is extended from the annular member positioned in the rear portion of the sheath to the operating member along the inner surface or outer surface of the sheath. The slit fm may be provided to be extended from the front edge of the sheath. The built-in spring may be provided at any suitable position in the sheath. The operating member may be constructed so that the bottom portion thereof is reciprocatingly fitted into a slot or recess provided along the axis of the sheath. The operating member may be provided with guiding ribs at both sides.

The illustrated writing instrument may be produced as a high-grade one by using a sheath of metal and an operating member of higher quality. In that case it is possible to apply the name of a company or the like on the operating member. Alternatively it is possible to manufacture the instrument as a disposable one.

Furthermore, it is to be appreciated that the components of the instrument and the arrangement thereof may suitablly be modified if desired.

Figure 8:
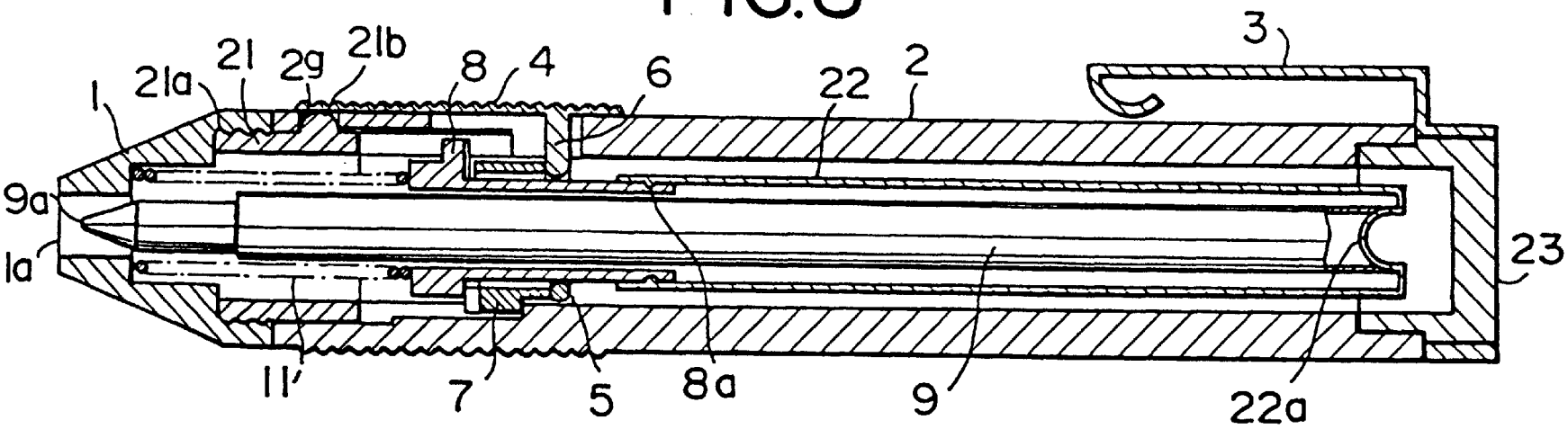
FIG. 8 is a longitudinal section showing a writing instrument according to a modification of the first embodiment shown in FIGS. 1 to 5, in which the tip of the refill is retracted into the hollow body.

FIG. 8 shows a modified embodiment of the present invention, in which the components corresponding to those illustrated in FIGS. 1 to 7 are given the same reference numerals.

In this modified embodiment, the ferrule 1 and the sheath 2, which form a main body, are coupled with each other by a joint member 21 of a cylindrical shape. The joint member 21 is provided with an external thread 21*a* at the front outer surface portion and a protuberance 21*b* at the rear outer surface portion. The external thread 21*a* of the joint member 21 is engaged with an internal thread provided on the rear inner portion of the ferrule 1, and the protuberance 21*b* is fitted into an engaging bore 2*g* provided on the sheath 2. The operating member 4 is extended over the engaging bore 2*g* so that the latter is covered with the former.

By the provision of the joint member 21, it is not necessary to provide an internal thread on the inner surface of the opened front end portion of the sheath 2 as in the first embodiment mentioned above. The joint member 21 also serves as a stopper for the rotary cam 8 or other components. The rear portion of the rotary cam 8 is extended rearwardly beyond the rear end of the sliding cam 7. On the extended rear portion of the rotary cam 8 there is formed a groove 8*a* on which a front portion of a refill casing 22 is fastened, thereby avoiding an increase in the diameter of the assembly of the rotary cam 8 and the refill casing 22.

The annular member 5 is arranged to abut on the rear end surface of the shorter cylindrical sliding cam 7. The inner diameter of the annular member 5 is selected so that there is no interference between it and the extended rear portion or cylindrical portion of the rotary cam 8 when the latter is inserted through the annular member 5. The refill casing 22 can be inserted into the sheath 2 through the opening of the rear end thereof, and connected with the rear end portion of the rotary cam 8. The refill casing 22 has an inwardly curved rear end wall 22*a* which is inserted into the opening in the rear end of the refill 9. Alternatively, the rear end portion of the refill casing 22 may be formed so as to enclose and hold the rear end of the refill 9. On the rear end opening of the sheath 2 is fitted a plug 23 for closing it.

The built-in spring 11 is inserted between the rotary cam 8 and the ferrule 1 so that the rear end of the spring 11 abuts on the front end of the rotary cam 8.

These components are assemblied in a following manner.

The assembly of the operating member 4 and the annular member 5 is inserted through the slit 2*e* into the sheath 2, and then the operating member 4 is rotated by 90° so that it is aligned with the slit and thus the annular member 5 is coaxially disposed within the sheath 2.

Then, the sliding cam 7, the rotary cam 8 and the spring 11 are in turn inserted into the sheath 2 through the front end opening thereof.

Next, the joint member 21 is attached to the front portion of the sheath 2 by fitting the protuberance 21*b* into the engaging bore 2*f*. In this connection it is to be arranged that there may be defined a space sufficient to move the rotary cam 8.

After the refill casing 22 is inserted into the sheath 2 through the rear end opening thereof and is securely fitted into the groove 8*a* of the rear portion of the rotary cam 8, the rear end opening of the sheath 2 is closed by inserting the plug 23 thereinto.

Then, the refill 9 is inserted into the refill casing 22 from the front end opening of the sheath 2.

Finally, by clamping the ferrule 1 on the front end portion of the sheath 2, the assembling can be completed.

In the modified embodiment of FIG. 8, the slit on the sheath 2 may be provided to be extended from the front edge of the front opening. In that case, since it is not necessary to rotate the actuating member 4 by 90° at the assembling thereof, the operating member 4 may be provided with an arm which is connected to the sliding cam 7. Also the front end portion of the sheath 2 may be provided with an extension of a relatively smaller diameter on which a reinforcing ring may be fitted for preventing the slit from being spread out.

Figure 9:
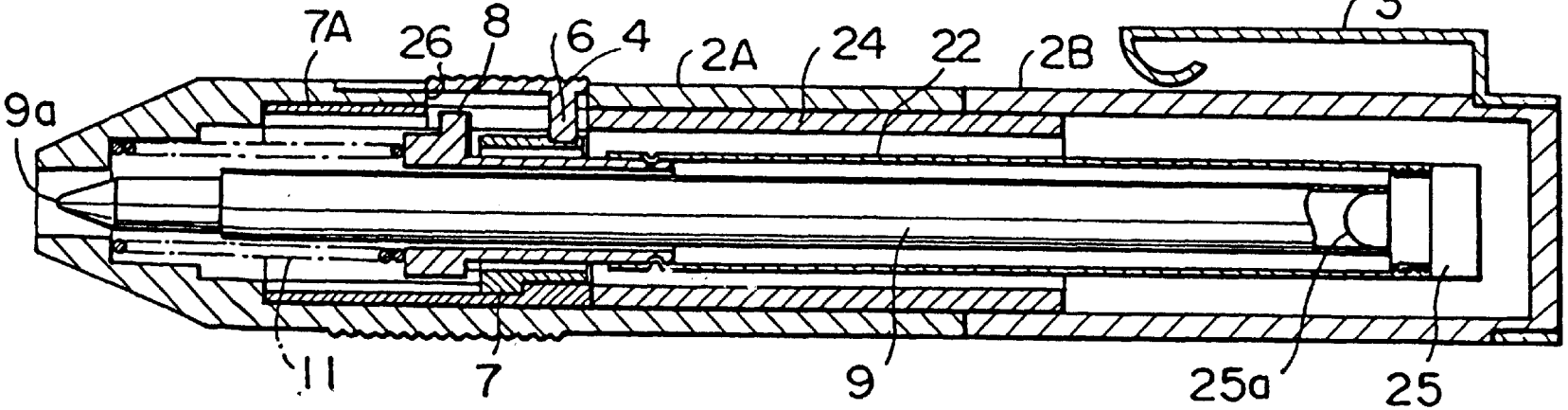
FIG. 9 is a longitudinal section showing an another modification of the first embodiment with the tip retracted into the hollow body.

FIG. 9 shows an another modification of the embodiment illustrated in FIGS. 1 to 7, in which the components corresponding to those illustrated in FIGS. 1–7 and 8 are given the same reference numerals.

In the embodiment shown in FIG. 9, a sheath or a main body comprises a front body portion 2A and a rear body portion 2B of metal which are connected with each other via a cylindrical joint member 24. The front body portion 2A is integrally provided with a ferrule at the front end. The refill casing 22 is formed by a metal pipe, and has an opened front end securly fitted to a groove 8*a* on the outer surface of the rear portion of the rotary cam 8 and an opened rear end to which a plug 25 is attached. The plug 25 is provided with an inner portion 25*a* (for example a protuberance or a recess) for holding the rear end of the refill 9. In this case the used refill 9 may be replaced by removing the rear body portion 2B and then removing the plug 25 from the rear end of the refill casing 22.

Since the ferrule is integrally provided on the front end of the front body portion 2A, the sliding cam 7 and the rotary cam 8 can not be inserted into the sheath from the forward end thereof as in the case of the previously described embodiments. In the embodiment of FIG. 9, therefore, there is provided an assembly of a cam cylinder 7A, the sliding cam 7 and the rotary cam 8, which is inserted into the front body portion 2A from the rear end thereof. After the insertion of the cam assembly into the front body portion 2A, the joint member 24 is mounted to the opened rear end of the front body portion 2A. The joint member 24 also serves as a holder for the cam cylinder 7A. The cam cylinder 7A is provided with a longitudinally extended slit for guiding the operating member 4.

The front body portion 2A of the sheath is provided with a hyperelliptic shaped bore 26 into which the operating member 4 is slidably fitted. In this arrangement, the upper or outer surface of the operating member 4 may be substantially aligned with the outer surface of the front body portion 2A thereby giving the completed instrument with an attractive appearance. The length of the bore 26 is determined so that the operating member 4 may be moved forwards and backwards over 6.5 mm.

Conveniently, the cam cylinder 7A may be plated with chromium at the portion which is visually exposed when the operating member 4 stays in its most rear position, and may be marked with a red marking at another portion which is visually exposed when the operating member 4 is moved in its most forward position. By the provision of the marking on the cam cylinder 7A, the user can easily ascertains whether the refill 9 and tip 9*a* are retracted after using of the instrument.

In assembling of the writing instrument shown in FIG. 9, firstly the spring 11, the assembly of the cam cylinder 7A, the sliding cam 7 and the rotary cam 8, and the refill casing 22 are in turn inserted into the front body portion 2A. Then, the joint member 24 is mounted on the front body portion 2A so as to unmovably situate the inserted cam cylinder 7A at the predetermined position therein. After that, the refill 9 is attached to the plug 25 and then the plug 25 is mounted on the rear end of the refill casing 22 by introducing the refill 9 thereinto. Next, the rear body portion 2B is attached to the rear portion of the joint member 24.

Finally, the connecting rod or leg 6 of the operating member 4 is inserted into the slit on the cam cylinder 7A and fitted to the recess of the sliding cam 7. In this way the instrument can be completed.

Figure 10:
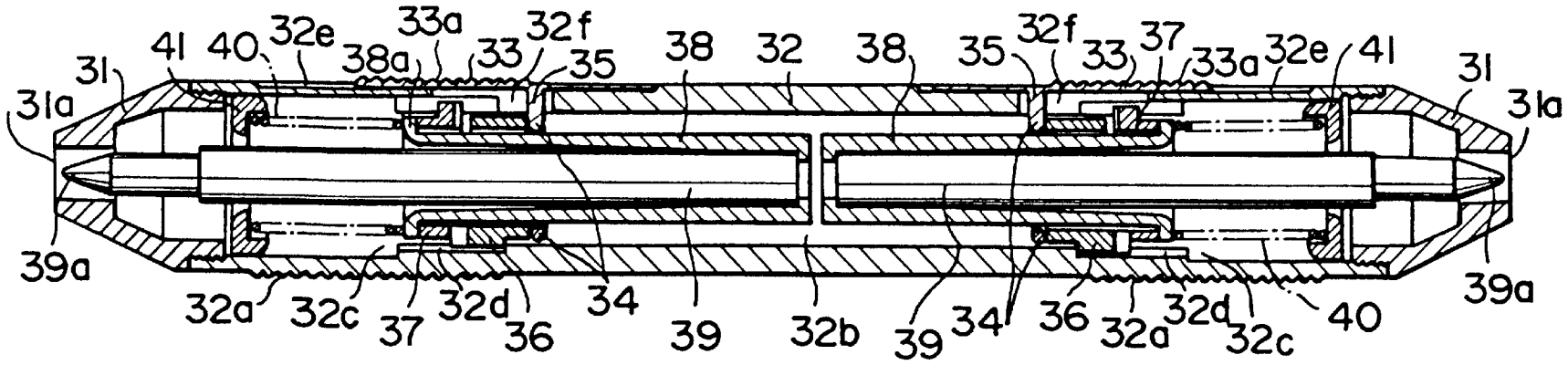
FIGS. 10 and 11 are longitudinal sections of a writing instrument according to a second embodiment of the present invention, showing different position of tips, one in the retracted position into the hollow body and another in the writing position of tips, respectively.
Figure 11:
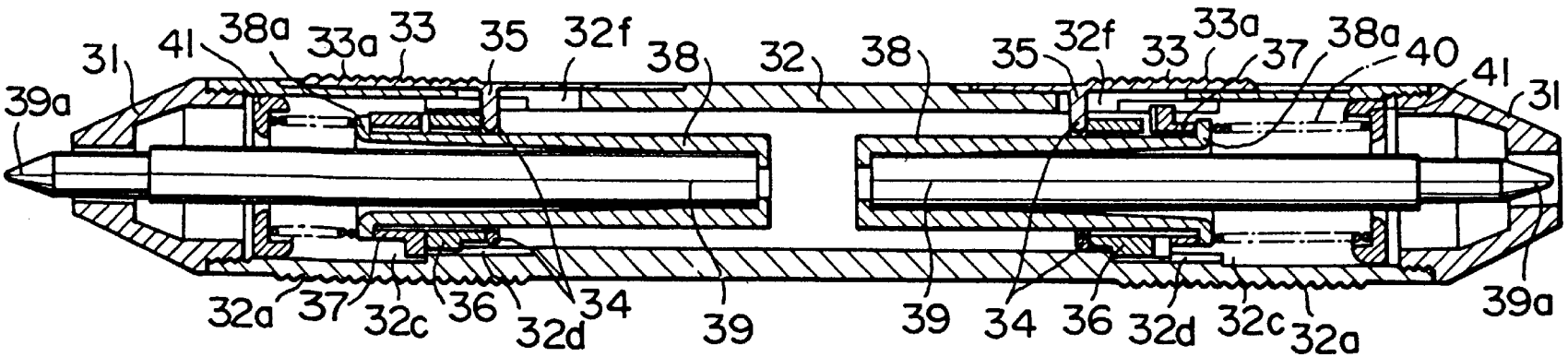
Figure 12:
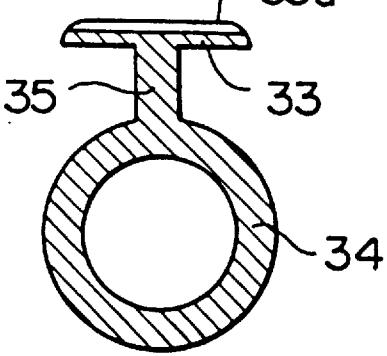
FIG. 12 is a cross section showing an operating member used in the writing instrument of FIGS. 10 and 11.

FIGS. 10 to 12 shows a further embodiment of the present invention which is carried out as a double tip type retractable writing instrument.

In FIG. 10, the reference numerals 31 and 31 represent two ferrules, each having a tapered peripheral surface, which are attached to the both ends of a sheath 32, respectively. Each ferrule 31 is provided with an opening 31*a* at the front end, and has a rear end portion thereof of relatively small diameter provided with an external thread. Each ferrule 31 may be made of metal, synthetic resin or other suitable material. The sheath 32 is provided with an internal thread at the inner side of each opened end. Each ferrule 31 is secured to the associated end of the sheath 32 by screwing the external thread of the former into the associated internal thread of the latter thereby forming an instrument body.

The sheath 32 has a hexagonal outer surface and a circular inner surface in cross section. One of six surface portions of the hexagonal outer surface of the sheath 32 is smoothly formed. On the remaining five surfaces are provided knurl ed portions 32*a* and 32*a* at the positions to be grasped by a user's finger-tip when in use. The sheath 2 defines a cylindrical space 2*b* which extends from the position near one end to the position near the other end portion thereof.

As illustrated in FIGS. 10 and 11, each opened end portion of the sheath 32 is provided with three deep cam grooves 32*c* and three shallow cam grooves 32*d* which are alternatively arranged and are equally spaced along the inner peripheral surface as in the first embodiment shown in FIGS. 2 to 5.

The reference numerals 33 and 33 denote operating members. As shown in FIG. 12, each operating member 33 is integrally ocnnected with an annular member 34 via a connecting rod 35. Each annular member 34 and each connecting rod 35 have a circular cross section of the same diameter. Each of the operating members 33 has a knurled surface 33*a* for preventing the user's fingertips from slipping.

The inner diameter of each annular member 34 is set so that it can be tightly fitted on the outer portion of a sliding cam 7.

The smoothly formed outer surface portion of the sheath 32 is provided with recesses 32*a* each of which is axially extended adjacent to the respective end thereof. Within each of the recesses 32*e* there is formed a slit 32*f* with which the connection rod 35 is slidably engaged. It is, therefore, to be appreciated that each slit 32*f* should be formed so that it has a width slightly larger than that of each operating member 33 and a length longer than that of the diameter of the connecting rod 35 pluse a stroke of the operating member 33 required to drive the propelling mechanism.

In the illustrated arrangement, each of the operating members 33 may be thinner and any suitable shape. In stead of the provision of the knurled surface 33*a* on each operating member 33, therefore, it is possible to engrave each operating member 33 with a symbolic mark of the city or school, the emblem of a company or the main character of the favorite comic picture or the like for making propaganda as well as the protection against slipping. Alternatively, each operating member 33 may be formed so that it has a shape similar to that of the emblem of a company or school.

For mounting each operating member 33 and each annular member 34 in the sheath 32, each annular member 34 is aligned with the intended slit 32*f* and then is inserted through the slit 32*f* into the sheath 32. The connecting rod 35 is positioned within the slit 32*f*. Next, each operating member 33 is aligned with the axis of the slit 32*f* by rotating the former by 90°, which results in that each annular member 34 is coaxially disposed within the sheath 32.

In the sheath 32 are provided two cam assemblies each of which comprises a sliding cam 36 and a rotary cam 37 which may be of any suitable conventional type. In the sheath 32 are also provided two refill supporters 38 each of which is intended to support the rear portion of a refill 39. Each refill supporter 38 is provided with a flange 38*a* at the front edge, and the inner diameter of each refill supporter 38 is slightly increased toward the front edge so that the associated refill 39 can be easily introduced thereinto. In FIGS. 10 and 11 there is shown a hole on the rear end wall of each of the refill supporters 38. These holes may be necessarily used during the molding of the refill supporters. Therefore, these holes may be omitted if the refill holders 38 are to be made of suitable metal material.

Each refill supporter 38 on which the associated sliding cam 36 and rotary cam 37 are fitted is inserted into the sheath 32 through each opened end thereof, in which the inner end of the each sliding cam 36 abuts on the associated annular member 34. On the flange 38*a* of each refill supporter 38 there is disposed a spring 40 which is supported by a stopper ring 41 in a slightly compressed condition therebetween. Each stopper ring 41 is fixed on the inner side of the sheath 32. After each of the refill 39 is inserted into the sheath 32 through the associated opened end thereof, the ferrules 31 are attached on the respective opened ends of the sheath 32. In this way there is obtained an arrangement shown in FIG. 10.

With the arrangement shown in FIG. 10, since the sliding cams 36 and the rotary cams 37 are always fitted on the outer surfaces of the refill holders 38, respectively, these cams can be moved without any inclining. Also, since each annular member 34 is slidably received on the associated refill supporter 38, each operating member 33 can be smoothly moved without any rolling. Further, each refill 39 has an ink reservoir made of metal and is provided with no protuberance for a stopper member and thus the rear end of each refill 39 should be supported by the associated refill supporter 38.

In the condition of FIG. 10, each of the sliding cams 36 and 36 abuts against the rear end of the associated shallow cam groove 32*d* and thus each of the refills 39 is retained at the retracted position in the sheath 32, that is each refill 39 is retained by the propelling mechanism. In this connection, the shallow cam grooves 32*d* may be formed as a single groove which is extended between the both ends of the sheath 32. In that case, there may be arranged that the connecting rods 35 and 35 are stopped by abutting them against the respective slits 32*f* and 32*f*. Alternatively, the arrangement may be designed so that by abutting the rear ends of the both refill supporters 38 to each other under the functions of the springs 41 and 41 the both refills 39 are retained at the respective retracted positions in a balanced state. It is, therefore, to be understood that the refills 39 are not necessarily retained by means of the propelling mechanism in the respective retracted positions.

When in use, the user graspes the holding position on either side of the sheath 32 with his or her fingertips, and pushes the operating member 33 toward the most advanced position with any one (for example the thumb) of his or her fingers. As a result, the associated sliding cam 36 is forwards moved against the spring 11 by the annular member 34 and then is shifted up to the most advanced position thereby slightly rotating the cooperated rotary cam 37. After that, as the operating of the operating member 33 is ceased the rotary cam 37 is slightly retracted by the function of the spring 11 while being rotated and thus is engaged with the front edge of the cooperated shallow cam groove 32*d*. In this way the assembly is taken in the condition of FIG. 11 in which the tip 39*a* of one of the refills 39 is protruded and set at the writing position. In this connection, the other refill 39 is retained in its retracted position because the both refills 39 are independently arranged and thus not cooperated.

At the termination of the writing, by again forwards forcing the associated operating member 33 with any one (for example the thumb) of his or her fingers the cooperated connecting rod 35, annular member 34, sliding cam 36, rotary cam 37, refill supporter 38 and refill 39 may be further advanced and then as the forcing of the operating member 33 is released these components are returned to the initial or retracted position as shown in FIG. 10.

There will herein be omitted the detailed description about the functions or operations of the sliding cams 37, the rotary cams 38, the deep cam grooves 32*c* and the shallow cam grooves 32*d* because they are widely used in conventional knocking type ball-point pens.

If one of the refills 39 gets out of an ink or it is wanted to replace it with a new one having a tip of a different size, the associated ferrule 31 is unscrewed so that the front end portion of the refill 39 is exposed, and then it can be easily pulled out from the sheath 32. In this case, the associated refill holder 38 is also moved forwards together with that refill 39, but is retained by the function of the cooperated spring 40, and thus only the refill 39 can be removed. New refill can be set in the sheath 32 by inserting it into the emptied refill holder 38. During the replacing of refill, the components in the sheath 32 are retained by the associated ring 41 and thus none of them can come out.

Figure 13:
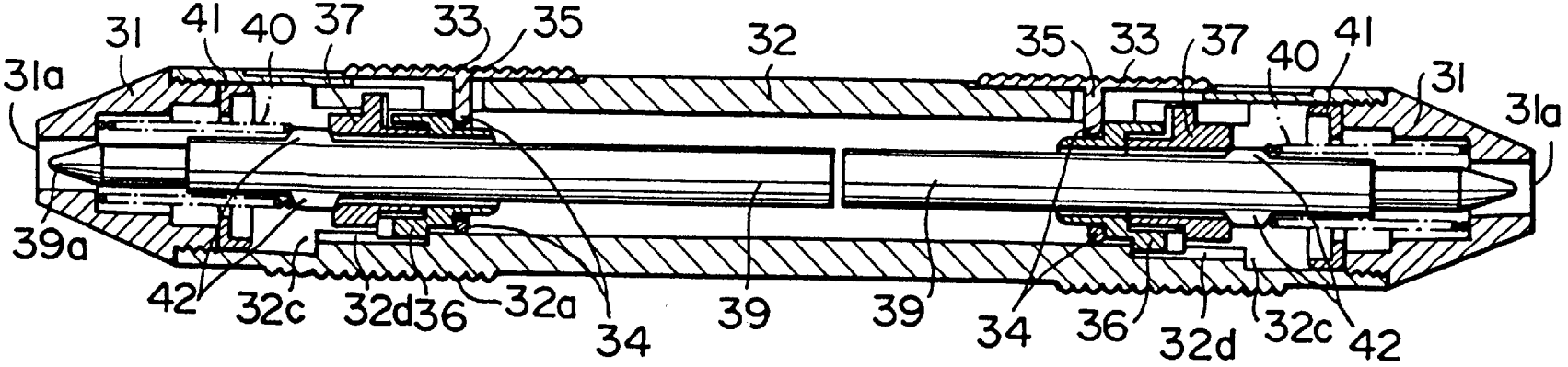
FIG. 13 is a longitudinal section showing a modification of the second embodiment shown in FIGS. 10 and 11.

FIG. 13 shows a modified embodiment of the double tip type capless writing instrument according to the present invention. This modified embodiment is similar to the previously mentioned one in the point that there are provided two propelling mechanisms each comprising a set of cam grooves 32*c*, cam grooves 32*d*, a sliding cam 36 and a rotary cam 37, and each propelling mechanism is operated by an assembly (operating member) of a operating member 33, an annular member 34 and a connecting rod 35 therebetween.

In this modified embodiment, each of refills 39 is provided with an annular protuberance or crimp 42 the rear end of which abuts on the front or outer edge of an associated rotary cam 37. On the front portion of each refill 39 is engaged a spring member 40. By mounting an associated ferrule 31 on each end portion of a sheath 32 each spring member 40 is slightly compressed between the annular protuberance 42 of each refill 39 and the inner shoulder portion of the associated ferrule 31. Stopper rings 41 are mounted in such a manner that they make soft contact with the inner side of the sheath 32. Each stopper ring 41 is intended to prevent the components in the sheath 32 from coming out when the associated ferrule 31 is removed or unscrewed.

With the embodiment of FIG. 13, conveniently, each refill 39 may be made of suitable resin material because the annular protuberance or crimp 42 can be easily formed thereon.

It should be understood that the embodiments illustrated in FIGS. 10 to 13 are never intended to restrict the scope of the present invention and thus may be modified or changed.

For example, the refills may comprise one for a ball-point pen using an oil-based ink and the other for a ball-point pen using a water-based ink. Alternatively, one of the refills may be for a ball-point pen using an oil-based ink and the other for a mechanical pencil or propelling pencil. Further refills may be used which are different from each other in the size or shape of the tip, or color of an ink.

Furthermore, it is possible to use any suitable propelling mechanism which may be operated by the operating member via a connecting or coupling means. Also, the operating mechanism my be designed so that each annular member is engaged with the rear end portion of the associated refill and the cooperating connecting rod is extended from the annular member to the associated operating member along the inner surface or outer surface of the sheath. Each of the slits for guiding the associated connecting rod may be provided to be extended from the associated front or outer edge of the sheath. Each of the built-in springs may be provided at any suitable position in the sheath. Each operating member may be constructed so that the associated slit is not exposed when the operating member is moved. The number of the operating members are not necessarily two, and thus they may be integrally formed. In that case, both cam grooves and both slits may be extended in a direction opposite to each other, and both refills may be retained at their respective retracted positions by abutting their rear ends to each other.

Further, if necessary, the refills may be constructed so that they are provided with ink reservoirs of different sizes or alternatively a common ink reservoir, and also the rear end portions of refills may be intersected to each other in the sheath. It is possible to movably provide a pocket clip on the sheath so that it can be displaced at the position which does not interfere with the writing when in use.

It is to be understood that the above-mentioned embodiments are only illustrative of the application of the principles of the present invention. Numerous modifications and alterations may be made by those skilled in the art without departing from the spirit and scope of the invention, and the appended claims are intended to cover such modifications and alterations.

What is claimed is:

1. A writing instrument comprising:

a hollow body;

a writing member accommodated in said hollow body;

a spring accommodated in said hollow body for forcing said writing member backwardly;

moving means for moving said writing member between a retracted position and a writing position, said moving means including a rotary cam, having a central bore through which said writing member is extendable, for receiving said writing member, a sliding cam, having a cam surface for engaging said rotary cam and a central bore through which said writing member is extendable, for actuating said rotary cam when said sliding cam is displaced forwardly toward a forward end portion of said hollow body, said hollow body including a forward portion having a inner surface provided with cam grooves for cooperating with said cams to guide said cams;

an operating member provided on said hollow body and arranged to be operated by a finger of a user at a holding position for operating said moving means to control extending and retracting of said writing member;

an engaging member for engaging said sliding cam; and connecting means, extending through a slit provided in the forward portion of said hollow body provided with said cam grooves, for connecting said engaging member and said operating member together.

2. A writing instrument comprising:

a hollow body;

a writing member accommodated in said hollow body;

a spring accommodated in said hollow body for forcing said writing member backwardly;

moving means for moving said writing member between a retracted position and a writing position, said moving means including a rotary cam, having a central bore through which said writing member is extendable, for receiving said writing member, a sliding cam, having a cam surface for engaging said rotary cam and a central bore through which said writing member is extendable, for actuating said rotary cam when said sliding cam is displaced forwardly toward a forward end portion of said hollow body;

a cam cylinder accommodated in and affixed to a forward portion of said hollow body and having an inner surface provided with cam grooves for cooperating said cams to guide said cams;

an operating member provided on said hollow body and arranged to be operated by a finger of a user at a holding position for operating said moving means to control extending and retracting of said writing member;

an engaging member for engaging said sliding cam; and connecting means, extending through a first slit provided in the forward portion of said hollow body and a second slit provided in said cam cylinder, for connecting said engaging member and said operating member together.

3. A writing instrument according to claim 1 or 2, wherein said operating member, said connecting means and said engaging member are integral.

4. A writing instrument according to claim 1 or 2 wherein said engaging member is annular and is coaxially disposed within said hollow body.

5. A writing instrument according to claim 1 or 2, wherein said writing member includes stop means for engaging said rotary cam so as to limit backward movement of said writing member.

6. A writing instrument according to claim 1 or 2, further comprising a writing member holder, operable in association with the operation of said rotary cam, for detachably holding said writing member.

7. A writing instrument according to claim 1 or 2, wherein said instrument comprises two writing members accommodated in said hollow body, wherein said hollow body has two end portions each including an opening through which a tip of a respective writing member is extendable, and wherein said instrument comprises two sets of components each actuating a respective writing member and each comprising a said spring, a said moving means, a said operating member, a said connecting means and a said engaging member.

8. A writing instrument according to claim 1 or 2, wherein said engaging member includes a bore having a surface engaging said sliding cam.

* * * * *